US008925890B2

(12) United States Patent
Liaw

(10) Patent No.: US 8,925,890 B2
(45) Date of Patent: Jan. 6, 2015

(54) LOCK FOR MUSICAL INSTRUMENT STAND

(71) Applicant: Yuan Terng Liaw, Taichung (TW)

(72) Inventor: Yuan Terng Liaw, Taichung (TW)

( * ) Notice: Subject to any disclaimer, the term of this patent is extended or adjusted under 35 U.S.C. 154(b) by 271 days.

(21) Appl. No.: 13/662,542

(22) Filed: Oct. 28, 2012

(65) Prior Publication Data

US 2014/0117173 A1 May 1, 2014

(51) Int. Cl.
*G10G 5/00* (2006.01)

(52) U.S. Cl.
USPC ..... 248/443; 248/451; 248/452; 248/453; 248/122.1; 248/124.2; 248/125.8; 248/121; 248/309.1; 248/316.1; 248/316.5; 84/327; 84/329; 211/85.6

(58) Field of Classification Search
CPC ..... A47B 23/004
USPC ..... 248/443, 441.1, 451, 452, 453, 122.1, 248/124.2, 125.8, 154, 121, 166, 220.21, 248/220.22, 221.11, 222.11, 222.12, 229.1, 248/229.13, 229.23, 230.4, 231.51, 309.1, 248/316.1, 316.5; 84/327, 329; 403/322.3, 403/322.1, 322.4, 325, 326; 211/85.6, 120; 297/186; 206/314; 292/194, 195, 292/DIG. 37, 1
See application file for complete search history.

(56) References Cited

U.S. PATENT DOCUMENTS

| | | | | |
|---|---|---|---|---|
| 900,889 | A * | 10/1908 | Schuster | 119/806 |
| 2,423,584 | A * | 7/1947 | Currier | 248/309.1 |
| 6,439,532 | B1 * | 8/2002 | Yu | 248/443 |
| 6,513,768 | B1 * | 2/2003 | Hsieh | 248/121 |
| 6,772,981 | B1 * | 8/2004 | Yu | 248/122.1 |
| 6,881,884 | B2 * | 4/2005 | Hsieh | 84/327 |
| 7,151,213 | B2 * | 12/2006 | Hsieh | 84/453 |
| 7,547,835 | B1 * | 6/2009 | Mayor | 84/327 |
| 7,906,717 | B2 * | 3/2011 | Wang | 84/327 |
| 8,020,817 | B2 * | 9/2011 | Yu | 248/125.8 |
| 8,490,942 | B1 * | 7/2013 | Henry | 248/441.1 |
| 8,636,255 | B2 * | 1/2014 | Rodrigues | 248/154 |
| 8,763,961 | B1 * | 7/2014 | Yang | 248/122.1 |
| 2009/0151538 | A1 * | 6/2009 | Lippert et al. | 84/327 |
| 2011/0303804 | A1 * | 12/2011 | Rodrigues | 248/122.1 |

* cited by examiner

*Primary Examiner* — Terrell McKinnon
*Assistant Examiner* — Michael McDuffie

(57) ABSTRACT

A height adjustable stand for musical instrument includes a connecting housing including a sleeve secured to the stand, a bifurcation extending out of the sleeve and including a top opening communicating with a slot therein, and two limit surfaces on both sides of the opening respectively; two opposite hooks each pivotably secured to the bifurcation and including a coupling member including a spring receptacle, a lever, an inclined surface adjacent to the receptacle, and a latch, and a curved member extending from the coupling member; a torsion spring biased between the spring receptacles; and a lock pivotably supported in the opening and including a first part, a second part at an angle with respect to the first part, and a protrusion on a bottom of the first part. Pressing of the first part moves the protrusion out of the slot to unlock the hooks.

7 Claims, 6 Drawing Sheets

A—A

LOCK FOR MUSICAL INSTRUMENT STAND

BACKGROUND OF THE INVENTION

1. Field of the Invention

The invention relates to locking devices and more particularly to a lock for a musical instrument (e.g., guitar) stand.

2. Description of Related Art

A guitarist may place a guitar upright against an object (e.g., a wall) to keep the guitar from being stepped when the guitarist takes a break. However, the guitar can easily fall onto the ground to be damaged when it is placed against an object without being fastened or locked. For protecting guitars, stands for stringed instruments are devised and commercially available.

For example, a conventional lock for a guitar stand comprising a connecting housing adapted to attach to the guitar stand, a locking housing movably connected to the connecting housing and including two shafts horizontally and rotatably extending out of the locking housing, each shaft having a lip securely, perpendicularly connected to a free end of the shaft, and a stud extending out of the connecting housing to securely attach to the guitar stand. A weight can be added to the two shafts to move the locking housing relative to the connecting housing and thus rotate the shafts. As a result, the lips move toward each other to hold the guitar in place.

Notwithstanding the prior literature, the invention is neither taught nor rendered obvious thereby.

SUMMARY OF THE INVENTION

It is therefore one object of the invention to provide a stand for a musical instrument comprising a base; a support tube disposed on the base; a sliding tube is slidably secured to the support tube; a pivotal support extending from the support tube; a connecting housing comprising a sleeve releasably secured to an end of the sliding tube distal the support tube, a bifurcation extending out of the sleeve to be distal the end of the sliding tube, the bifurcation including an upper member, a lower member, a slot defined between and by the upper and lower members, an opening formed on a top surface of the upper member and communicating with the slot, two limit surfaces on both sides of the opening respectively, two seats projecting from both sides of the opening toward inside of the opening respectively, and two pivots each formed on a grooved top of the seat; two opposite hooks each pivotably secured to the bifurcation and comprising a coupling member including a spring receptacle, a lever, an inclined surface adjacent to the receptacle, and a latch, and a curved member extending from the coupling member; a torsion spring biased between the opposite spring receptacles; and a lock comprising a first part, a second part at an angle with respect to the first part, a protrusion extending downward from a bottom of the first part, and a fulcrum pivotably supported by the grooved tops of the seats when the lock is disposed in the opening; wherein in a locked position the protrusion is disposed in the slot with the protrusion engaging the inclined surfaces and the latches engaging the limit surfaces respectively; wherein a pressing of the first part moves the protrusion out of the slot to unlock the hooks and a subsequent pressing of the levers toward each other to engage the inclined surface of one coupling member with the inclined surface of the other coupling member, compress the torsion spring, disengage the latches from the limit surfaces respectively, and increase a distance between an open end of one curved member and that of the other curved member; and wherein a pressing of the second part to insert the protrusion into the slot locks the hooks in the locked position, compress the torsion spring, disengage the latches from the limit surfaces respectively, and increase a distance between an open end of one curved member and that of the other curved member; and wherein a pressing of the second part to insert the protrusion into the slot locks the hooks in the locked position.

The above and other objects, features and advantages of the invention will become apparent from the following detailed description taken with the accompanying drawings.

DETAILED DESCRIPTION OF THE INVENTION

Figure 1:
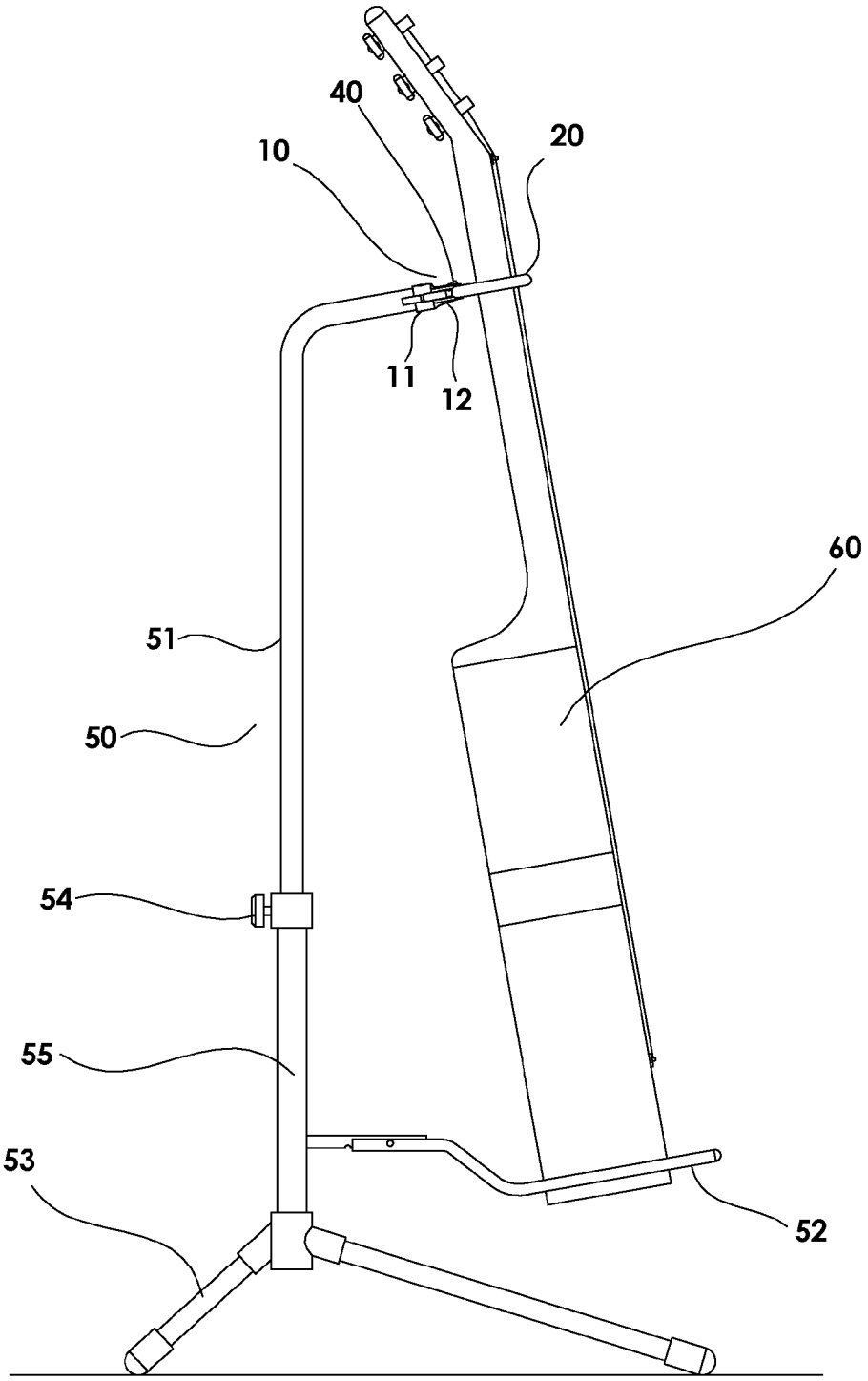
FIG. 1 is a side elevation of a musical instrument stand according to the invention.
Figure 2:
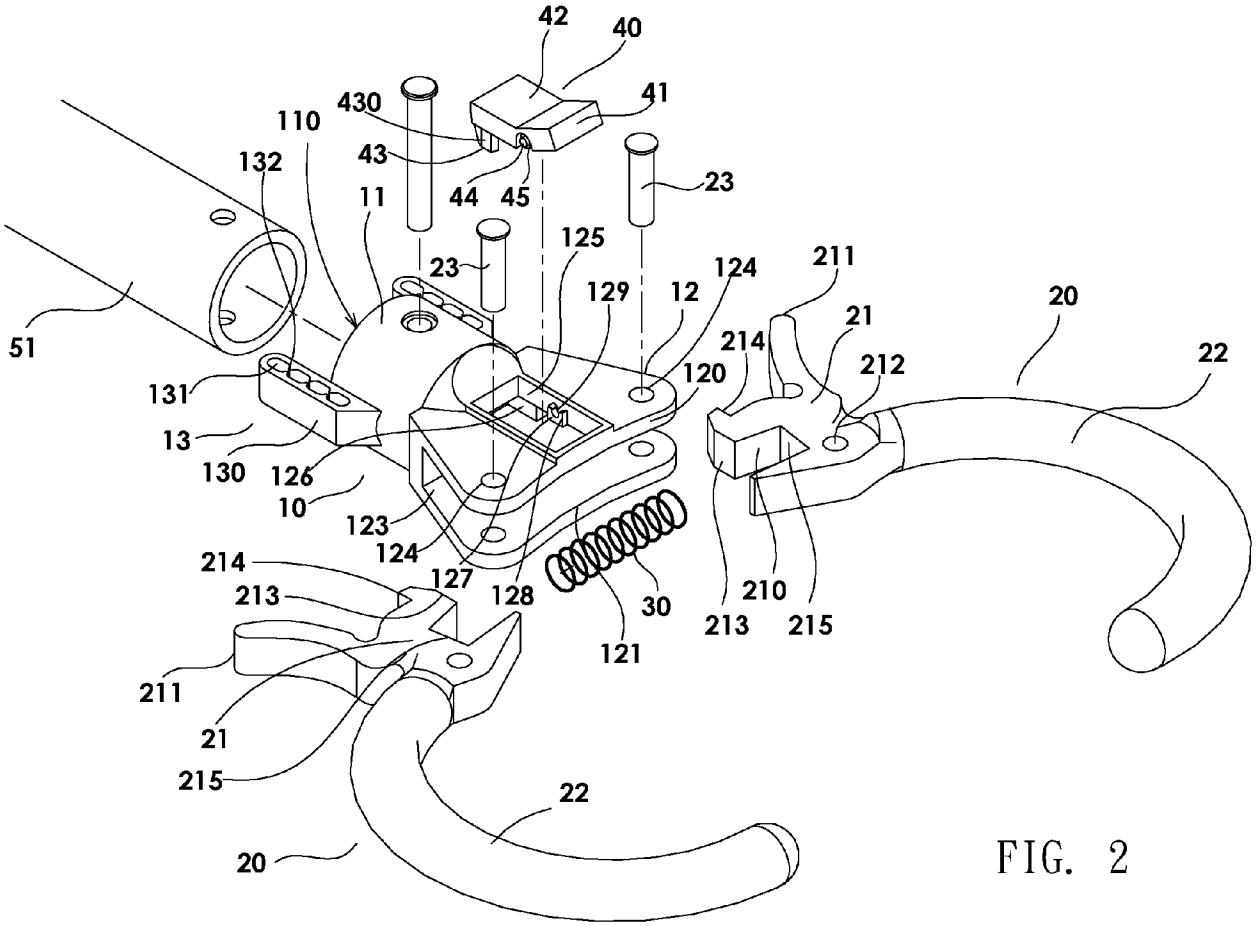
FIG. 2 is an exploded view of a device mounted at a free end of a sliding tube of the stand for locking a guitar.

Referring to FIGS. 1 to 10, a stand 50 for musical instrument (e.g., guitar) 60 according to the invention is shown.

The stand 50 comprises the following components: A sliding tube 51 is slidably disposed in a support tube 55 which in turn has a bottom end provided with a base 53. An adjustment knob 54 is provided on a top end of the support tube 55 so that a portion of the sliding tube 51 received in the support tube 55 can be adjusted by manipulating the adjustment knob 54 in a manner known in the art (i.e., height of the stand 50 being adjustable). A pivotal support 52 extends from a lower portion of the support tube 55.

The subject of the invention is a device for locking a guitar 60 when the guitar 60 is supported by the stand 50. The device comprises the following components as discussed in detail below.

A connecting housing 10 is provided at an end of an upper bent portion of the sliding tube 51. The connecting housing 10 comprises a sleeve 11 having a bore 110 for receipt of the end of the upper bent portion of the sliding tube 51. A fastener (not numbered) is driven through the upper bent portion of the sliding tube 51 and the sleeve 11 to fasten them together. The connecting housing 10 further comprises a bifurcation 12 extending out of the sleeve 11 to be distal the upper bent portion of the sliding tube 51. The bifurcation 12 comprises an upper member 120, a lower member 121, a slot 123 defined between and by the upper and lower members 120 and 121, two holes 124 through two front corners of the upper and lower members 120 and 121, an opening 125 formed on a top surface of the upper member 120 and communicating with the slot 123, a limit surface 126 on either side of the opening 125 proximate the sleeve 11, two concave seats 128 having a longitudinal section of C projecting from both sides of the opening 125 toward inside respectively, and two pivots 127 each formed on a grooved top 129 of the seat 128. The grooved top 129 has a longitudinal section of V.

The connecting housing 10 further comprises a pick retaining member 13 formed on either side of an outer surface of the sleeve 11. The pick retaining member 13 is elongated and comprises a body 130, a plurality of connected holes 131 through top and bottom of the body 130, and a plurality of slits 132 each between the two adjacent holes 131. A pick of a musical instrument (e.g., guitar) 60 may be retained in the slit 132 when not in use.

Two opposite hooks 20 together are shaped as a C. Each hook 20 comprises a coupling member 21 including a spring receptacle 210, a lever 211, a through hole 212, an inclined surface 213 adjacent to the mouth of the receptacle 210, a latch 214 engaged with and stopped by the limit surface 126, and a spring urging surface 215 at an inner end of the spring receptacle 210; a curved member 22 of circular longitudinal section extending from a position of the coupling member 21 proximate the through hole 212 and having a body 220 and a padded member 221 formed on the body 220; and two pivots 23 each driven through the hole 124 and the through hole 212 to pivotably fasten the hook 20 and the bifurcation 12 together.

A torsion spring 30 is disposed between the opposite spring receptacles 210 to have both ends urging against the spring urging surfaces 215 respectively. A lock 40 comprises a first part 41, a second part 42 at an angle with respect to the first part 41, a protrusion 43 extending downward from bottom of the second part 42, the protrusion 43 having a U-shaped cross-section and including two opposite outer stop surfaces 430 each engaged with the inclined surface 213, and two opposite inner stop surfaces 431 each spaced from the corresponding outer stop surface 430, a transverse groove 44 on a bottom of a joining portion of the first and second parts 41, 42, and a fulcrum 45 formed in the groove 44 to be pivotably supported by the two grooved tops 129 when the lock 40 is disposed in the opening 125.

Figure 3:
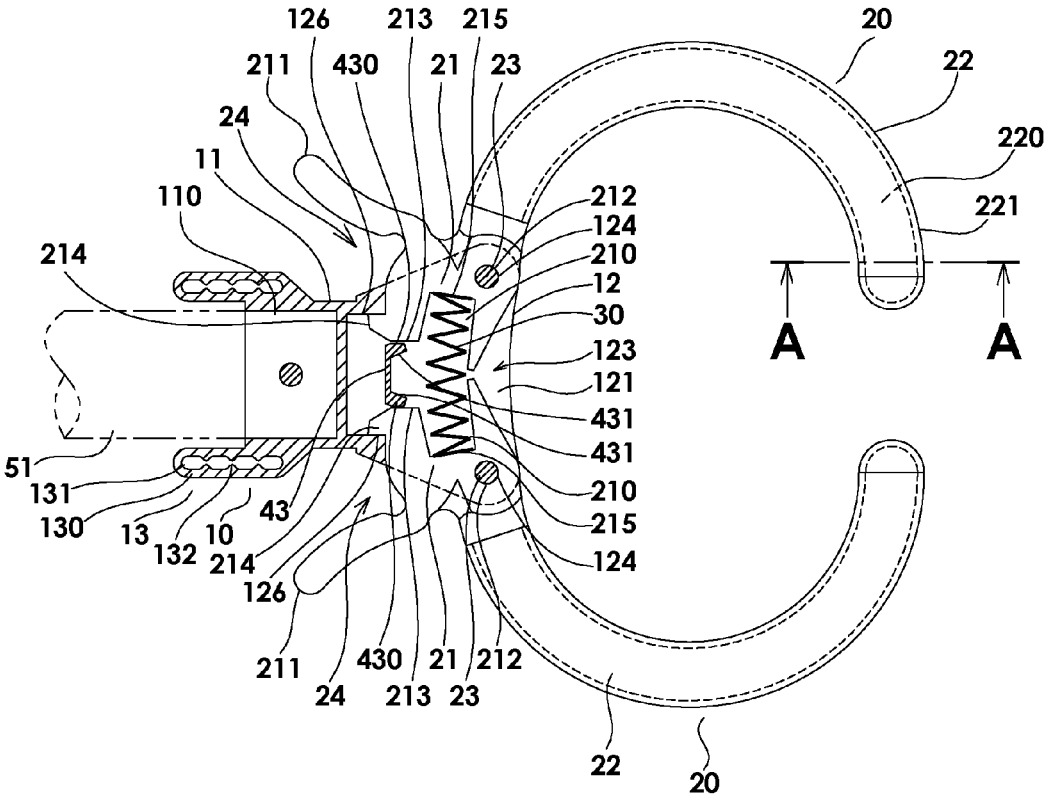
FIG. 3 is a top view in part section of the device in its locked position.
Figure 4:
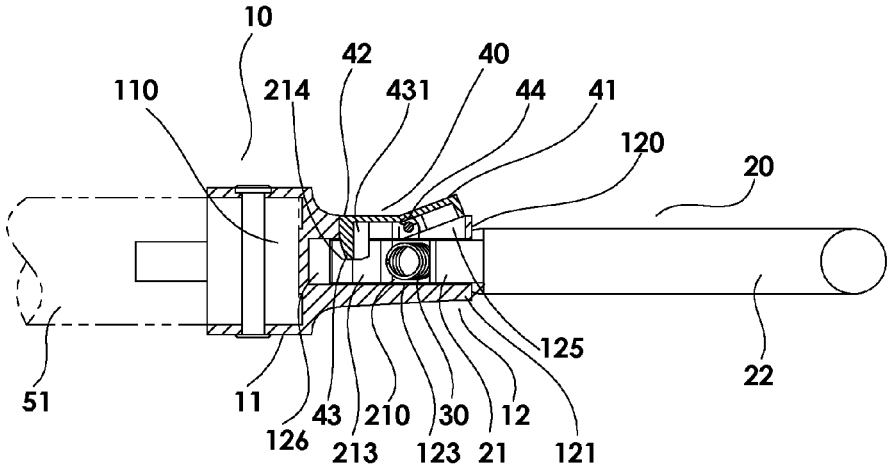
FIG. 4 is a longitudinal sectional view of the device of FIG. 3.

As shown in FIGS. 3 and 4, in a locked position of the invention the protrusion 43 is disposed in the slot 123 to have the outer stop surfaces 430 lockingly engage with the inclined surfaces 213 respectively and the latches 214 lockingly engage with the limit surfaces 126 respectively. Also, the torsion spring 30 is expanded. Further, the hooks 20 are locked. At this inoperative position, an operating space 24 is defined by the lever 211 and the sleeve 11 at the same side of the sleeve 11, an upper portion of the guitar is lockingly received in and supported by the hooks 20, and a bottom thereof is rested upon the support 52.

Figure 5:
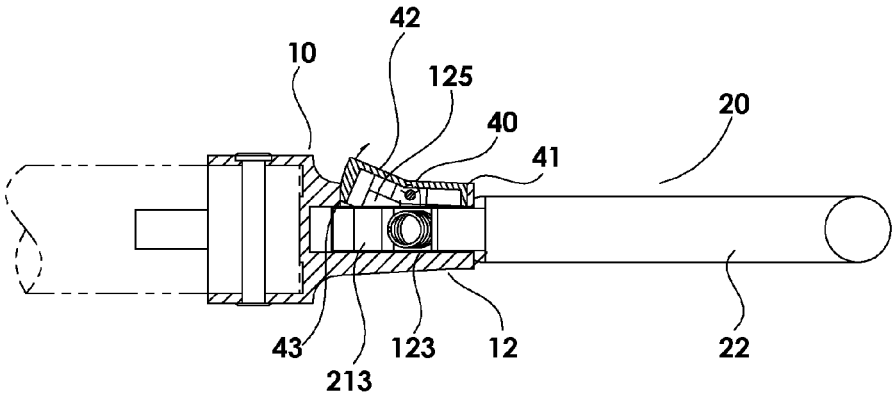
FIG. 5 is a view similar to FIG. 4 showing the first part of the lock being pressed to counterclockwise pivot the second part thereof in a first step of unlocking the device.
Figure 6:
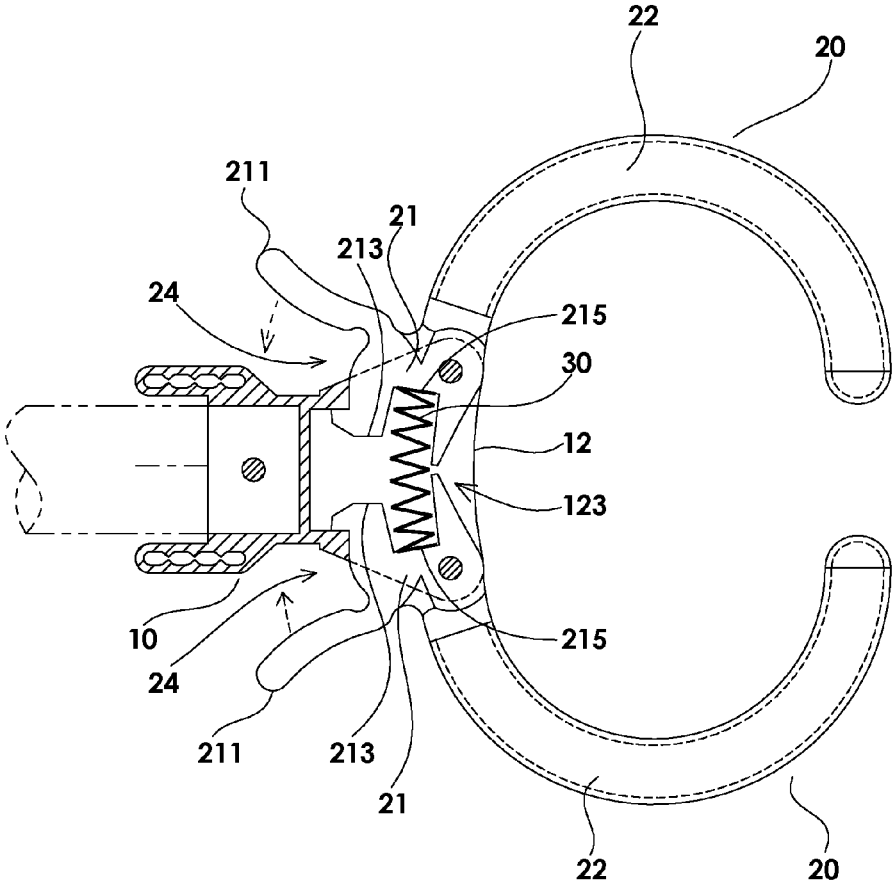
FIG. 6 is a top view in part section of the device shown in FIG. 5 in its unlocked position.
Figure 7:
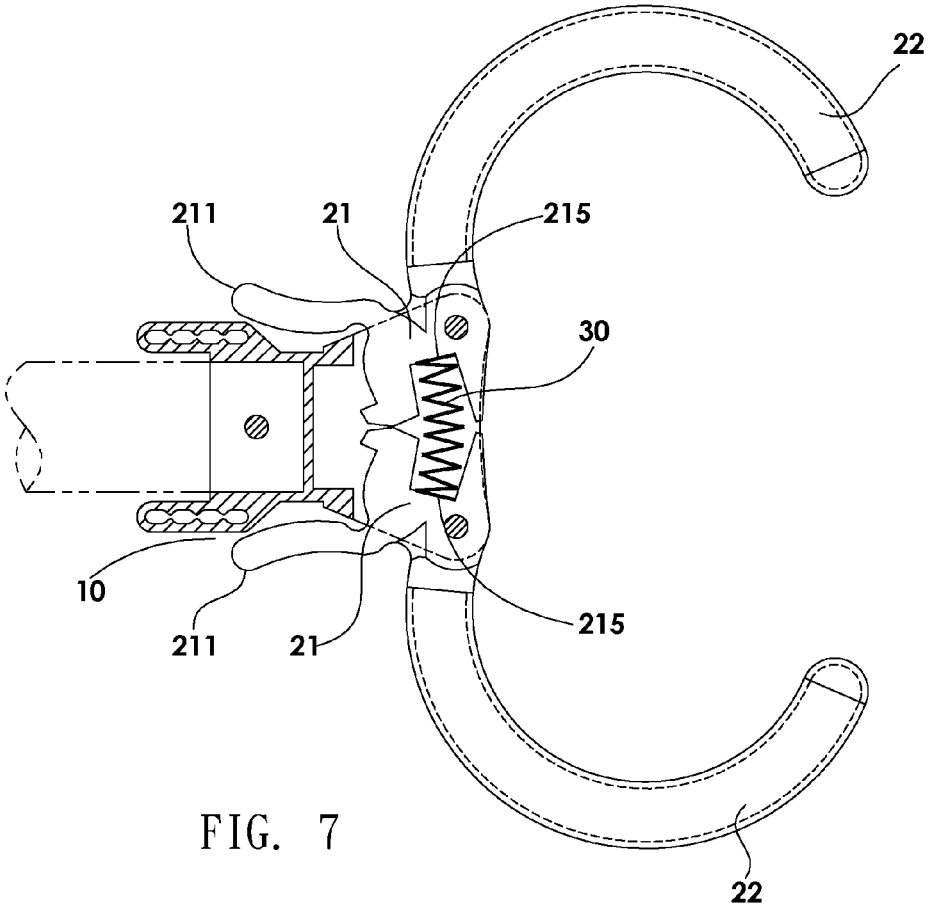
FIG. 7 is a view similar to FIG. 6 showing a C-shaped yoke consisting of the hooks being open wide at the end of unlocking the device.

As shown in FIGS. 5 to 7, for unlocking the invention, an individual (e.g., guitarist) may press the first part 41 until the first part 41 engages a front end of the opening 125 and the outer stop surfaces 430 disengage from the inclined surfaces 213 respectively. As such, the hooks 20 are unlocked. Then the individual presses the levers 211 toward each other (as indicated by arrows) until an edge of one inclined surface 213 engages an edge of the other inclined surface 213. As such, the torsion spring 30 is compressed and an opening of a C-shaped yoke consisting of the hooks 20 becomes wide. At this position, an upper portion of the guitar 60 is unlocked so that the individual may take the guitar 60 out of the stand 50 for playing.

Figure 8:
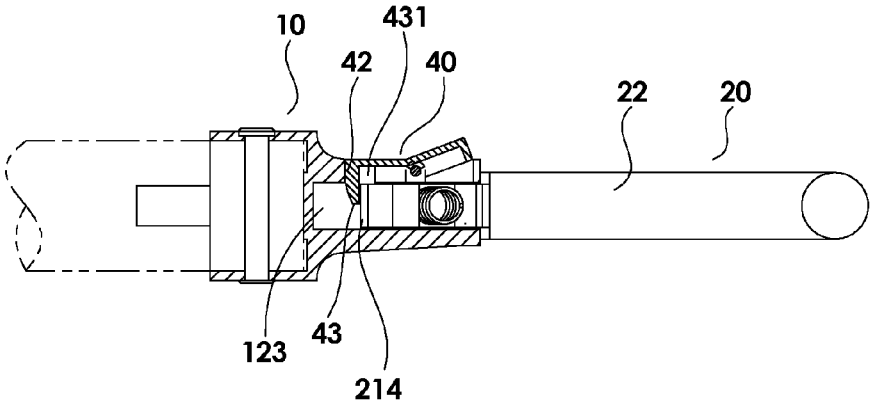
FIG. 8 is a longitudinal sectional view of the device of FIG. 7.
Figure 9:
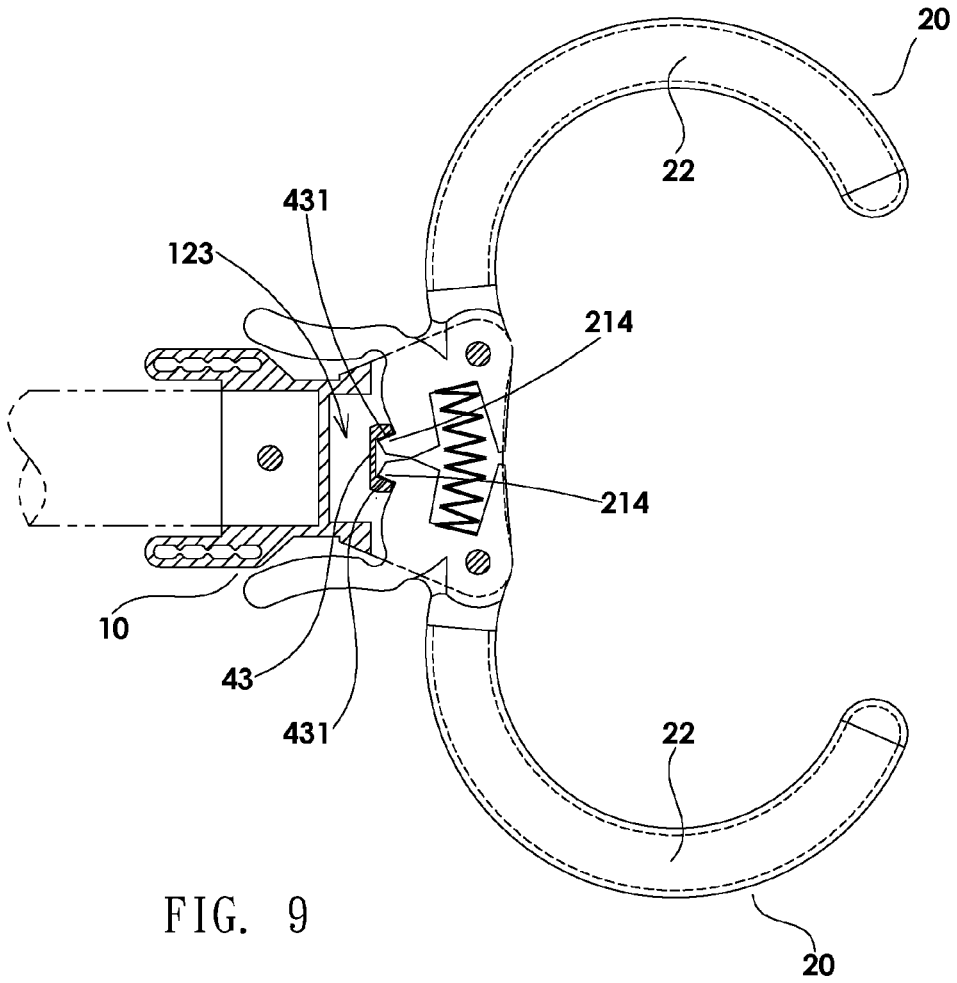
FIG. 9 is a view similar to FIG. 7 showing the wide open yoke being locked after the protrusion inserted into the groove.
Figure 10:
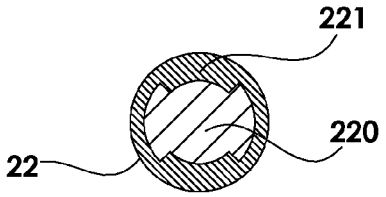
FIG. 10 is a sectional view taken along lines A-A of FIG. 3 showing the curved member of the hook.

As shown in FIGS. 8 and 9, after removing the guitar 60, the individual may perform the following steps to lock the invention. First, the individual presses the second part 42 to insert the protrusion 43 into the slot 123 to lockingly engage the inner stop surfaces 431 with the latches 214 respectively. As a result, the hooks 20 are locked again with the opening of the yoke consisting of the hooks 20 remains wide.

While the invention has been described in terms of preferred embodiments, those skilled in the art will recognize that the invention can be practiced with modifications within the spirit and scope of the appended claims.

What is claimed is:

1. A stand for a musical instrument comprising:

a base;

a support tube disposed on the base;

a sliding tube is slidably secured to the support tube;

a pivotal support extending from the support tube;

a connecting housing comprising a sleeve releasably secured to an end of the sliding tube distal the support tube, a bifurcation extending out of the sleeve to be distal the end of the sliding tube, the bifurcation including an upper member, a lower member, a slot defined between and by the upper and lower members, an opening formed on a top surface of the upper member and communicating with the slot, two limit surfaces on both sides of the opening respectively, and two concave seats projecting from both sides of the opening toward inside of the opening respectively;

two opposite hooks each pivotably secured to the bifurcation and comprising a coupling member including a spring receptacle, a lever, an inclined surface adjacent to the receptacle, and a latch; and a curved member extending from the coupling member;

a biasing member biased between the opposite spring receptacles; and a lock disposed in the opening and comprising a first part, a second part at an angle with respect to the first part, a protrusion extending downward from a bottom of the first part, and a bottom fulcrum at a joining portion of the first and second parts pivotably supported by the concave seats;

wherein in a locked position the protrusion is disposed in the slot with the protrusion engaging the inclined surfaces and the latches engaging the limit surfaces respectively;

wherein a pressing of the first part moves the protrusion out of the slot to unlock the hooks and a subsequent pressing of the levers toward each other to engage the inclined surface of one coupling member with the inclined surface of the other coupling member, compress the biasing member, disengage the latches from the limit surfaces respectively, and increase a distance between an open end of one curved member and that of the other curved member; and wherein a pressing of the second part to insert the protrusion into the slot locks the hooks in the locked position.

2. The stand of claim 1, wherein each concave seat comprises a grooved top and a pivot formed on the grooved top.

3. The stand of claim 2, wherein each concave seat has a longitudinal section of C, and each grooved top has a longitudinal section of V.

4. The stand of claim 1, wherein the protrusion has a U-shaped cross-section and includes two opposite outer stop surfaces each engaged with the inclined surface, and two opposite inner stop surfaces each spaced from the corresponding outer stop surface.

5. The stand of claim 1, wherein the coupling member includes the spring receptacle, the lever, an inclined surface adjacent to the receptacle, the latch, and a spring urging surface at an inner end of the spring receptacle.

6. The stand of claim 1, wherein the sleeve has a bore for receipt of the end of the sliding tube, and the connecting housing further comprises an elongated pick retaining member formed on either side of an outer surface of the sleeve, the elongated pick retaining member including a body, a plurality of connected holes through top and bottom of the body, and a plurality of slits each formed between the adjacent holes.

7. The stand of claim 1, wherein the hooks are shaped as a C for receiving, supporting, and locking an upper portion of the musical instrument, and wherein the curved member and has a body member and a padded member formed on the body member.

* * * * *